US010697289B2

(12) United States Patent
Wheater et al.

(10) Patent No.: US 10,697,289 B2
(45) Date of Patent: Jun. 30, 2020

(54) ENVIRONMENTAL SENSING WIRELINE STANDOFF

(71) Applicants: Guy Wheater, Scarborough (GB); Stuart Huyton, Elgin (GB)

(72) Inventors: Guy Wheater, Scarborough (GB); Stuart Huyton, Elgin (GB)

( * ) Notice: Subject to any disclaimer, the term of this patent is extended or adjusted under 35 U.S.C. 154(b) by 223 days.

(21) Appl. No.: 15/831,164

(22) Filed: Dec. 4, 2017

(65) Prior Publication Data

US 2019/0169976 A1 Jun. 6, 2019

(51) Int. Cl.

| | |
|---|---|
| ***E21B 47/01*** | (2012.01) |
| ***E21B 47/12*** | (2012.01) |
| ***E21B 17/02*** | (2006.01) |
| ***E21B 17/20*** | (2006.01) |

(52) U.S. Cl.

CPC ..... *E21B 47/011* (2013.01); *E21B 17/023* (2013.01); *E21B 47/12* (2013.01); *E21B 17/206* (2013.01)

(58) Field of Classification Search

CPC ..... E21B 47/011; E21B 47/12; E21B 17/023; E21B 17/10; E21B 17/206

See application file for complete search history.

(56) References Cited

U.S. PATENT DOCUMENTS

| | | | | |
|---|---|---|---|---|
| 5,250,806 | A * | 10/1993 | Rhein-Knudsen | E21B 17/1078 250/254 |
| 2004/0178797 | A1* | 9/2004 | Rioufol | E21B 17/1078 324/367 |
| 2004/0238222 | A1* | 12/2004 | Harrison | E21B 7/04 175/61 |
| 2012/0018145 | A1* | 1/2012 | Wheater | E21B 17/206 166/241.5 |
| 2018/0066513 | A1* | 3/2018 | Sugiura | E21B 7/04 |

OTHER PUBLICATIONS

Nilsson, et al. ("Low-friction carbon-rich carbide coatings deposited by co-sputtering", Elsevier Science B.V., 2003) (Year: 2003).*

* cited by examiner

*Primary Examiner* — George S Gray
(74) *Attorney, Agent, or Firm* — Tumey L.L.P.

(57) ABSTRACT

The use of an environmental sensing wireline standoff may improve operations during borehole logging procedures. An environmental sensing wireline standoff may comprise a lower body, an upper body, and a cable insert. The cable insert may further comprise a first segment and a second segment, wherein the cable insert is disposed between the lower body and the upper body, and wherein the cable insert is configurable to clamp directly onto a wireline cable. The environmental sensing wireline standoff may further comprise a sensor package. A method of assembling an environmental sensing wireline standoff may comprise securing a first segment of a cable insert into a lower body, securing a second segment of the cable insert into an upper body, attaching the sensor package to the upper body, and securing the lower body to the upper body.

19 Claims, 5 Drawing Sheets

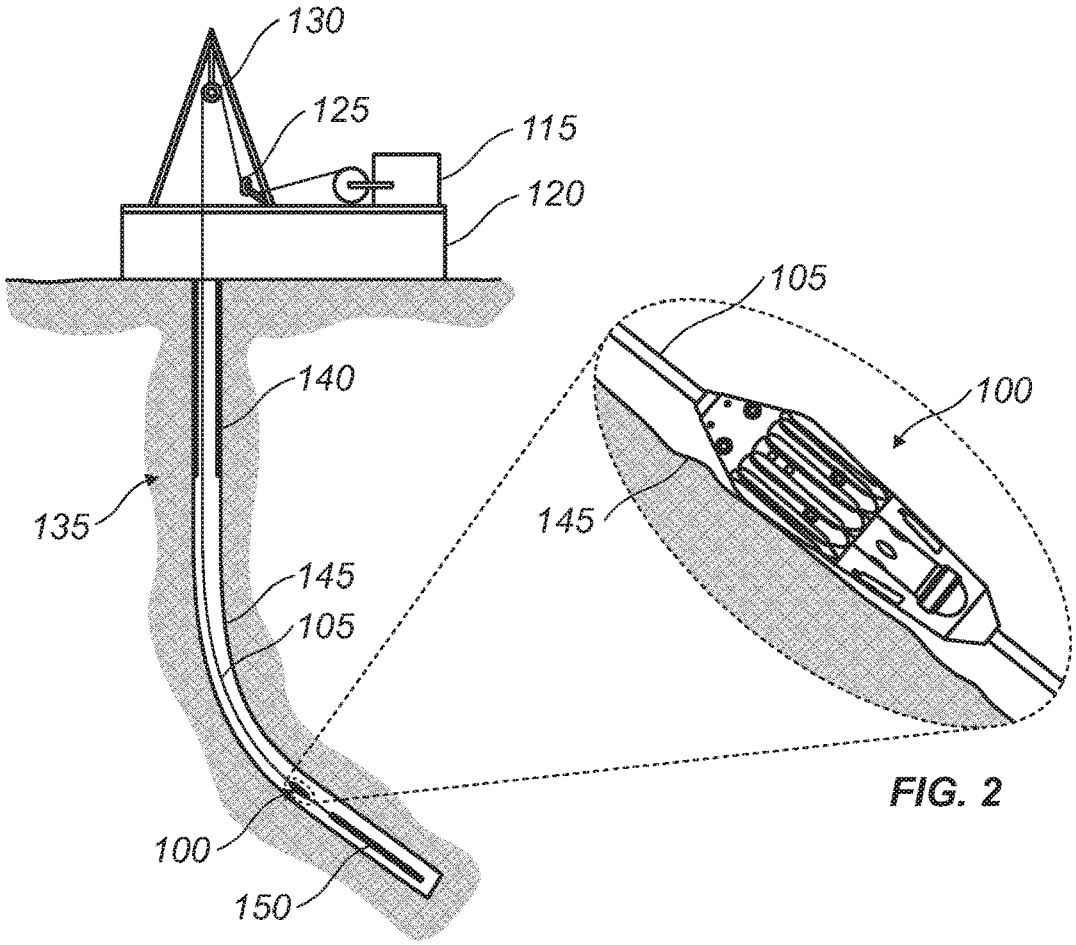
FIG. 2
FIG. 1
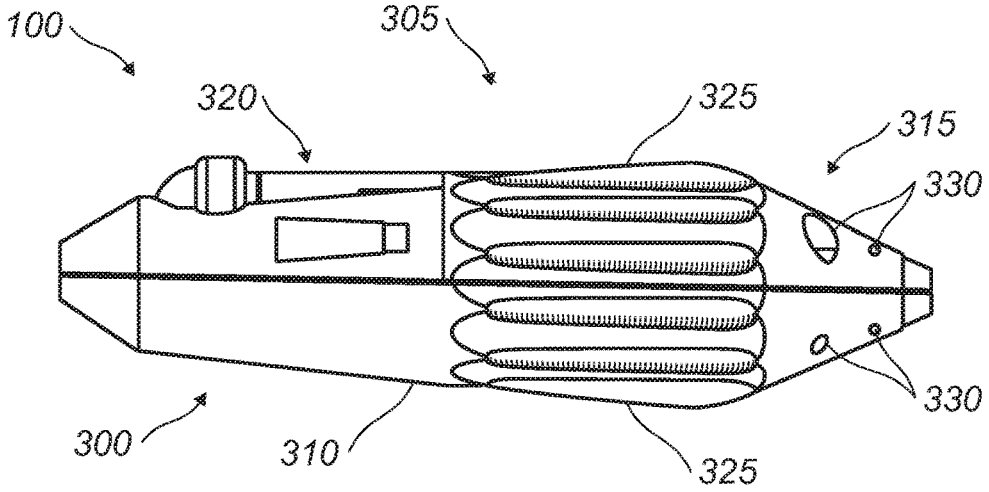
FIG. 3

ENVIRONMENTAL SENSING WIRELINE STANDOFF

BACKGROUND

Wireline logging is a common operation in the oil industry whereby downhole electrical tools may be conveyed on a wireline (also known as an "e-line") to evaluate formation lithologies and fluid types in a variety of boreholes. In certain wells there is a risk of the wireline cable and/or logging tools becoming stuck in the open hole due to differential sticking or cable key-seating. For example, cable key-seating may occur when the wireline cable cuts a groove into the borehole wall, and the wireline cable may become stuck in this groove. For instance, this may happen in deviated or directional wells where the wireline cable may exert considerable sideways thrust at the contact points with the borehole. Once a groove has been cut, a range of sticking mechanisms may occur, governed by geo-mechanics, geochemistry, drilling fluid, and lithologies. The end result may be a cancelled wireline survey or fishing operation.

In addition to cable key-seating, differential sticking may occur when there is an overbalance between hydrostatic and formation pressures in the borehole, the severity of which may be related to a number of issues. Issues may include the degree of overbalance and the presence of any depleted zones in the borehole, the character and permeability of the formations bisected by the borehole, the deviation of the borehole, since the sideways component of the tool weight adds to the sticking forces, the drilling mud properties in the borehole, since the rapid formation of thick mud cakes may trap logging tools and the wireline cable against the borehole wall, and/or the geometry of the toolstring being logged on wireline, since a long and large toolstring presents a larger cross sectional area and results in proportionally larger sticking forces. Additionally, during wireline formation sampling, the logging tools and wireline may remain stationary over permeable zones for a long period of time which also increases the likelihood of differential sticking.

To assess the cable sticking risk along a borehole, for both cable key-seating and differential sticking, physical measurements of cable contact zones and applied thrusts may be recorded. In this regard, an environmental sensing wireline standoff may be beneficial, clamped to the wireline cable to record data along the actual 3D cable path taken through the borehole. This data may improve cable sticking risk assessments and support advanced wireline tension modelling and wellbore diagnostics, to help determine borehole conditions and assess a broad range of wireline logging conveyance risks.

BRIEF SUMMARY OF SOME OF THE PREFERRED EMBODIMENTS

These and other needs in the art are addressed in one embodiment by an environmental sensing wireline standoff. The environmental sensing wireline standoff may comprise a lower body, an upper body, and a cable insert. The cable insert may be disposed between the lower body and the upper body. The cable insert may be configured to clamp directly onto a wireline cable.

These and other needs in the art may be addressed by an embodiment of a method of assembling an environmental sensing wireline standoff. The method may comprise of securing a portion of a cable insert into a lower body and securing a portion of the cable insert into an upper body. The upper body may comprise a first section and a second section, wherein the second section may comprise a sensor package and a cowl. The method may further comprise of attaching the sensor package to the first section, fastening the cowl around the sensor package and to the first section, and securing the lower body to the upper body.

These and other needs in the art may be addressed by an embodiment of a wireline assembly. The wireline assembly may comprise of a wireline cable, a borehole, and an environmental sensing wireline standoff. The environmental sensing wireline standoff may comprise of an upper body, a lower body, and a cable insert The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

BRIEF DESCRIPTION OF THE DRAWINGS

These drawings illustrate certain aspects of the present invention and should not be used to limit or define the invention.

FIG. 1 illustrates a wireline standoff installed on a wireline cable.

FIG. 2 illustrates a close-up view illustrating a wireline standoff in relation to the borehole wall.

FIG. 3 illustrates a profile view of a wireline standoff.

DETAILED DESCRIPTION

Figure 4:
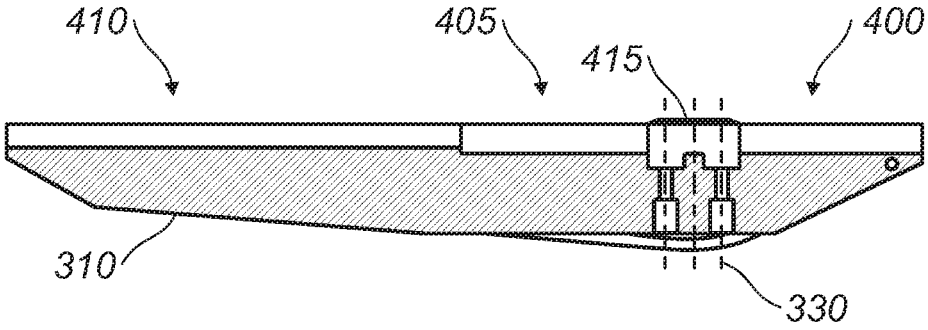
FIG. 4 illustrates a cross-sectional view of a half-shell of a wireline standoff.

The disclosure relates to wireline logging and, more particularly, in one or more embodiments, the disclosure relates to a device for improving wireline cable performance during logging operations in a variety of boreholes.

There may be several potential advantages to the devices and methods of the disclosure, only some of which may be alluded to herein. One of the many potential advantages of the disclosure is that the disclosure may ameliorate the effects of differential sticking and/or key-seating of the wireline cable by reducing or eliminating direct contact of the cable to the borehole wall. In accordance with present embodiments, this may be achieved by coupling a plurality of wireline standoffs and/or at least one wireline standoff onto the wireline cable, resulting, for example, in a lower contact area per unit length of open hole, lower applied sideways pressure of the wireline against the borehole wall, and/or lower cable drag when conveying the wireline in or out of the hole. Another potential advantage is that the disclosure may record borehole properties and cable dynamics during wireline and/or slickline logging operations. Without limitation, the wireline standoff may record cable position, movement, rotation, and acceleration, borehole temperature and pressure, borehole fluid composition, motion and loss zones, conductivity, and viscosity, gas content, road noise, borehole noise, and seismic signals generated from adjacent wellbores and/or from the surface. Yet another potential advantage is that the use of wireline standoffs may also enable more efficient use of wireline jars in the logging string since the standoffs may reduce the cable friction above the jars, allowing firing at lower surface tensions and easier re-rocking of the jars in boreholes where high cable drag may be a problem (attenuating the applied surface tension before it may reach the wireline cable head and jars).

FIG. 1 illustrates a generic logging operation that includes an environmental sensing wireline standoff 100 coupled to a wireline cable 105 in accordance with one embodiment of the disclosure. In embodiments, there may be a plurality of environmental sensing wireline standoffs 100. As illustrated, environmental sensing wireline standoff 100 may be clamped onto wireline cable 105. Wireline cable 105 may be, for example, stored on a wireline drum 110 and spooled into a well by a winch driver and logging engineer in a logging unit 115. In the illustrated embodiment, logging unit 115 is fixed to a drilling rig or a platform 120, and wireline cable 105 is deployed through the derrick via two or three sheaves 125, 130 to the maximum depth of the well. A borehole 135 may have a cased-hole section 140 and an open-hole section 145. As illustrated, environmental sensing wireline standoff 100 may be installed on wireline cable 105 in open-hole section 145. A logging tool 150 may be connected to the lower end of wireline cable 105 to take, for example, the petro-physical measurements or fluid or rock samples in the open-hole section 145 of borehole 135. A plurality of environmental sensing wireline standoffs 100, and their positions on wireline cable 105, may be determined by a number of factors, including for example, the length of open-hole section 145, the location of sticky, permeable, or depleted zones, and the overall trajectory of the well, which may be deviated or directional in nature.

FIG. 2 is a close-up view illustrating attachment of environmental sensing wireline standoff 100 to wireline cable 105. In the illustration of FIG. 2, environmental sensing wireline standoff 100 may be seen in relation to wireline cable 105 and the wall of open-hole section 145 of borehole 135.

One or more of environmental sensing wireline standoffs 100 may be used on wireline cable 105 in accordance with embodiments of the disclosure. An embodiment of the disclosure includes installation of a plurality of environmental sensing wireline standoffs 100 on wireline cable 105 to minimize wireline cable 105 contact over a selected zone(s) of open-hole section 145. Environmental sensing wireline standoffs 100 may be installed on wireline cable 105, for example, to either straddle known permeable zones where differential sticking is a risk (e.g., eliminating cable contact 100%) or they may be placed at regular intervals along wireline cable 105 to minimize key-seating, taking into account, for example, the dogleg severity of borehole 135. For boreholes 135 with higher dogleg severity, the spacing between environmental sensing wireline standoffs 100 on wireline cable 105 may be reduced. In certain embodiments, the spacing of environmental sensing wireline standoffs 100 on wireline cable 105 may be from about ten feet to more than one hundred feet, depending on the requirements for the particular borehole being logged.

FIG. 3 illustrates an environmental sensing wireline standoff 100 in accordance with one embodiment of the disclosure. In accordance with present embodiments, environmental sensing wireline standoff 100 may comprise of a lower body 300 and an upper body 305 which may mate together onto wireline cable 105. A variety of different fasteners may be used to couple lower body 300 and upper body 305 to one another. By way of example, fasteners may include nuts and bolts, washers, screws, pins, sockets, rods and studs, hinges and/or any combination thereof. In an embodiment, a combination of dowel pins and bolts may be used to couple lower body 300 and upper body 305 to one another. In one particular embodiment, four cap head bolts and four dowel pins may be used for coupling. The dowel pins may be used, for example, to resist shear forces.

As illustrated, lower body 300 may comprise a half shell 310 which contains a cable insert (described below). Upper body 305 may comprise a first section 315 and a second section 320. An end of first section 315 may be disposed about an end of second section 320 to form a shape similar to that of half shell 310. Second section 320 may comprise a sensing package and a cowl (described below). Lower body 300 and upper body 305 may comprise of the same and/or different dimensions and/or materials.

Lower body 300 and upper body 305 may comprise a suitable material, such as stainless steel or other high performance material. In an embodiment, lower body 300 and upper body 305 may be constructed from stainless steel. In addition, lower body 300 and upper body 305 may be surface hardened (e.g., vacuum hardened), in certain embodiments, for improved wear resistance during use. Lower body 300 and upper body 305 may be any suitable size, height, and/or shape. In embodiments, lower body 300 and upper body 305 may be in the shape of a shell. A wide range of shell sizes may be available for installation on wireline cable 105 (referring to FIG. 1). Without limitation, the range of shell sizes may be from about fifty mm to about one hundred and twenty five mm. In an embodiment, the maximum external diameter of environmental sensing wireline standoff 100 is less than the size of the internal diameters of the overshot and drill pipe that may be used in fishing operations so that environmental sensing wireline standoff 100 may safely fit inside a fishing assembly enabling the wireline cable head or tool body to be successfully engaged by the fishing overshot. In this manner, wireline cable 105 (referring to FIG. 1) and environmental sensing wireline standoff 100 may then be safely pulled through the drill pipe to the surface when the cable head is released from the logging string.

Lower body 300 and upper body 305 may further comprise of a plurality of fins 325. Among other things, fins 325 may allow easy movement along borehole 135 (referring to FIG. 1) and through mud cake and other debris which may have accumulated in borehole 135 during drilling. In an embodiment, fins 325 may be arranged along the length of lower body 300 and/or upper body 305. Alternatively, fins 325 may be arranged along a portion of the length of lower body 300 and/or upper body 305. There may be any suitable number of fins 325. In embodiments, there may be at least one fin 325. In an embodiment, environmental sensing wireline standoff 100 may comprise of twelve fins 325. In an embodiment, fins 325 may be distributed radially along the length of lower body 300 and/or upper body 305. The empty space between fins 325 may allow for circulation of drilling mud inside drill pipe if wireline cable 105 (referring to FIG. 1) and wireline standoff 100 are fished using drill pipe. In an embodiment, fins 325 may have a low coefficient of friction. In embodiments, fins 325 may be coated with a carbide coating. Fins 325 may have a smooth radial cross section to minimize the contact area with the wall of borehole 135 (referring to FIG. 1) and allow for standoff rotation under the action of cable torque. This may reduce the differential sticking force acted upon each fin 325 at the contact points with the wall of borehole 135 (referring to FIG. 1) and may also allow for easy rotation of environmental sensing wireline standoffs 100 if wireline cable 105 rotates when it is deployed and retrieved from borehole 135 (referring to FIG. 1). In other embodiments, fins 325 may contain holes cut along the lengths of each fin 325. Rollers may be housed in the holes cut along the length of each fin 325. Without limitation, rollers, ball bearings, wheels, and/or any other suitable device capable of rotating along a surface may be used. It may be noted that it is the general nature of wireline cable 105 to rotate during logging operations due to the opposing lay angles of the inner and outer armours which may induce unequal torsional forces when tensions may be applied. The design of environmental sensing wireline standoffs 100 may allow easy rotation of wireline cable 105 during the logging operation, avoiding, for example, the potential for damage if excessive torque was allowed to build up.

In addition, environmental sensing wireline standoff 100 may further comprise a plurality of holes 330 in lower body 300 and/or upper body 305. In an embodiment, holes 330 may extend across lower body 300 and/or upper body 305 for use of fasteners in installation. In an embodiment, lower body 300 and/or upper body 305 may contain four holes 330.

FIG. 4 illustrates a cross-sectional view of half shell 310 in accordance with an embodiment of this disclosure. In an embodiment, half shell 310 may comprise a front portion 400, a rear portion 410 and a middle portion 405 which interconnects front portion 400 and rear portion 410. In the illustrated embodiment, front portion 400 and rear portion 410 may each be conical in shape with middle portion 405 being generally cylindrical in shape. Front portion 400 and rear portion 410 may be used interchangeably. In the illustrated embodiment, half shell 310 may further include holes 330 through which fasteners (e.g. bolts) may be inserted that secure lower body 300 to upper body 305 (referring to FIG. 3). In embodiments, there may be a depression 415 traversing the length of an end of half shell 310 to another end of half shell 310. A portion of depression 415 may be the same shape and size of a cable insert (described below). In embodiments, lower body 300 and/or upper body 305 may comprise a cable insert. The process of securing lower body 300 to upper body 305 may clamp the cable inserts of both lower body 300 and upper body 305 onto wireline cable 105 (referring to FIG. 1).

Figure 5:
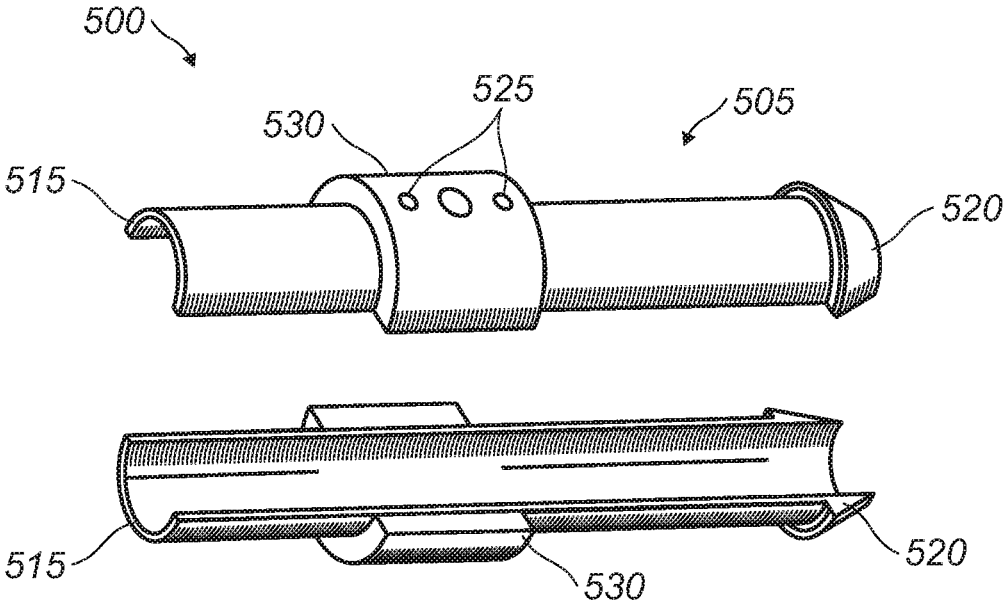
FIG. 5 illustrates an isometric view of a cable insert of a wireline standoff.

FIG. 5 illustrates an embodiment of a cable insert 500 in accordance with the disclosure. In embodiments, cable insert may comprise a first segment 505 and a second segment 510. A wireline cable 105, (referring to FIG. 1) may be disposed between first segment 505 and second segment 510. Lower body 300 and/or upper body 305 may attached to first segment 505, second segment 510, or vice versa. Cable insert 500 may comprise a suitable material that may deform when force is applied to it. Cable insert 500 may be deformable around the outer armour of wireline cable 105 (referring to FIG. 1) during installation without physically damaging wireline cable 105. Without limitation, a suitable material may be a metal, nonmetal, plastic, composite, and/or combinations thereof. In an embodiment, cable insert 500 may be made of aluminum. As illustrated, cable insert 500 may be in the general shape of a hollow cylinder. Cable insert 500 may have a first end 515 and a second flanged end 520. As illustrated, second flanged end 520 may be tapered and first end 515 may be raw. In an embodiment, when assembled, second flanged end 520 may extend beyond lower body 300 and upper body 305 (referring to FIG. 3) which may encase at least a portion of cable insert 500. First end 515 may be disposed within lower body 300 and upper body 305. Furthermore, in some embodiments, cable insert 500 may be positively secured into each of lower body 300 and upper body 305 by suitable fasteners that pass through the outside of each of lower body 300 and upper body 305 into tapped holes 525 in cable insert 500. Without limitations, suitable fasteners may include nuts and bolts, washers, screws, pins, sockets, rods and studs, hinges and/or any combination thereof.

In an embodiment, cable insert 500 may be configured to clamp directly onto wireline cable 105 (referring to FIG. 1) using bolts. In general, cable insert 500 may mate to form a central bore through environmental sensing wireline standoff 100 in accordance with certain embodiments. There may be a large range of cable inserts 500 available to fit wireline cable 105, where cable insert 500 may account for manufacturing tolerances and varying degrees of wear or distortion along the length of wireline cable 105. Therefore, for a plurality of environmental sensing wireline standoffs 100 installed on wireline cable 105, a range of different cable inserts 500 may be employed, for example, to ensure a fit which may not allow slippage along wireline cable 105 or damage to wireline cable 105 when coupled. The bolts that may be used to couple lower body 300 and upper body 305 together and may be torqued to a consistently safe limit with a calibrated torque wrench. In general, cable insert 500 may have no movement inside lower body 300 and upper body 305, in accordance with present embodiments. For example, a central spigot (see, e.g., anti-rotation spigot 900 on FIGS. 9 and 10) may be included to reduce or even eliminate rotation of cable insert 500 in lower body 300 and upper body 305. By way of further example, a central flange 530 on cable insert 500 may be used to ensure little to no axial movement in lower body 300 and upper body 305.

Central flange 530 may be circumferentially disposed around cable insert 500. In embodiments, central flange 530 may be disposed about the middle of first segment 505 and second segment 510. In other embodiments, central flange 530 may be formed around first segment 505 and second segment 510 during a manufacturing process. Central flange 530 may have an inner diameter and an outer diameter. The inner diameter of central flange 530 may be the same as the outer diameter of cable insert 500. The outer diameter of central flange 530 may be disposed in a portion of depression 415 (referring to FIG. 4) within half shell 310 (referring to FIG. 3). In embodiments, the shape of the portion of depression 415 matches the shape of cable insert 500 with central flange 530 disposed around it. In the particular embodiment, there may be no axial movement of cable insert 500 due to the material of lower body 300 (referring to FIG. 4) blocking the movement of central flange 530.

Figure 6A:
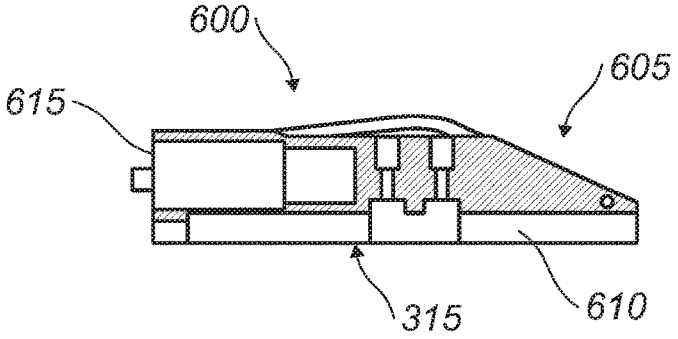
FIG. 6A illustrates a cross-sectional view of an end portion of a wireline standoff.
Figure 6B:
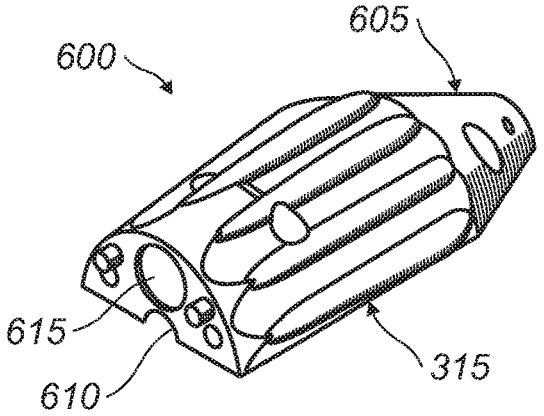
FIG. 6B illustrates an isometric view of an end portion of a wireline standoff.

FIG. 6A illustrates a cross-sectional view of first section 315 in accordance with one embodiment of the disclosure. FIG. 6B illustrates an isometric view of first section 315 in accordance with one embodiment of the disclosure. In an embodiment, first section 315 may comprise an end portion 600 and a receiving end 605. In the illustrated embodiment, end portion 600 may be conical in shape with receiving end 605 being generally cylindrical in shape. Receiving end 605 may comprise of holes wherein fasteners may be disposed. In embodiments, first section 315 may have a shorter length than lower body 300 (referring to FIG. 3). First section 315 may comprise a dip 610 traversing the length of an end of first section 315 to another end of first section 315. A portion of dip 610 may be the same size and shape of cable insert 500 (referring to FIG. 5). In embodiments, a portion of depression 415 of half shell 310 (referring to FIG. 4) may mirror a portion of dip 610 of first section 315. In embodiments, the remaining length of dip 610 of first section 315 may be shorter than the remaining length of depression 415 of half shell 310. First section 315 may comprise of holes that may be aligned with holes 330 of half shell 310. First section 315 may comprise of an internal cavity 615. In embodiments, a portion of internal cavity 615 may be threaded. Internal cavity 615 may serve to connect a sensor package to first section 315.

Figure 7:
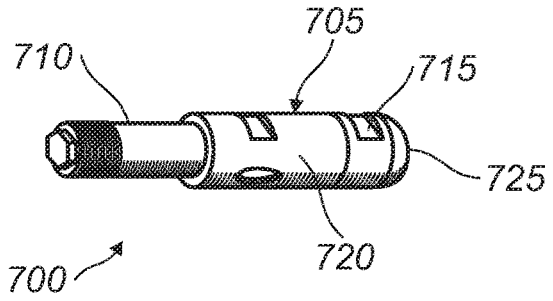
FIG. 7 illustrates an isometric view of a sensor package.

FIG. 7 illustrates an isometric view of a sensor package 700 in accordance with one embodiment of the disclosure. Sensor package 700 may serve to take measurements of parameters while environmental sensing wireline standoff 100 (referring to FIG. 1) may be disposed downhole. Sensor package 700 may be any suitable size, height, and/or shape. Sensor package 700 may be made from any suitable material. Without limitation, a suitable material may be a metal, nonmetal, plastic, composite, and/or combinations thereof. In embodiments, sensor package 700 may comprise of a containment unit 705 and a stem 710. Containment unit 705 may have a cylindrical shape. An end of containment unit 705 may be rounded. An opposing end of containment unit 705 may be flat. In embodiments, stem 710 may have a cylindrical shape. Stem 710 may have a smaller diameter than open section 800. An end of stem 710 may be disposed about the flat end of containment unit 705. An opposing end of stem 710 may be threaded. The threaded end of stem 710 may be inserted into the threaded portion of internal cavity 615 (referring to FIGS. 6A and 6B). Stem 710 and internal cavity 615 may function as a male/female attachment point. Stem 710, or a portion of stem 710, may be disposed within the rest of internal cavity 615. Containment unit 705 may be exposed to the downhole environment. In embodiments, containment unit 705 and/or stem 710 may be hollow. Sensor package 700 may house a sensor 715 in containment unit 705. In embodiments, there may be a plurality of sensors 715 disposed within sensor package 700. Without limitation, any sensor that may take measurements on cable position, movement, rotation, and acceleration, borehole temperature and pressure, borehole fluid composition, motion and loss zones, conductivity, and viscosity, gas content, road noise, borehole noise, seismic signals generated from adjacent wellbores and/or from the surface, and/or combinations thereof, may be disposed within sensor package 700. In embodiments, a pressure sensor gauge, a thermocouple, tri-axial accelerometers, and tri-axial magnetometers may be disposed within sensor package 700.

Containment unit 705 may comprise of a housing 720 and a lid 725. Lid 725 may be disposed about an end of housing 720. Lid 725 may be removable from housing 720. In embodiments, sensor 715 may be disposed within housing 720 and sealed within housing 720 by lid 725. In further embodiments, sensor 715 may be disposed on at least a portion of the outer surface of housing 720. Sensor package 700 may record data in real-time. Sensor package 700 may have the capacity to convey data to the surface for processing. Alternatively, sensor package 700 may be able to process data downhole. Sensor package 700 may comprise of electronics suitable for recording data, storing data, and/or communicating data to an information handling system. In the downhole environment, sensor package 700 may require protection from flowing fluids and materials. A cowl may be designed to shield sensor package 700 from the flowing fluids and materials.

Figure 8:
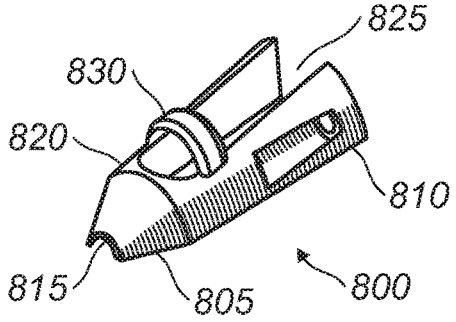
FIG. 8 illustrates a cross-sectional view of a cowl of a wireline standoff.

FIG. 8 illustrates an isometric view of a cowl 800 in accordance with one embodiment of the disclosure, wherein cowl 800 comprises a portion of second section 320 (referring to FIG. 3). Cowl 800 may be any suitable size, height, and/or shape. Cowl 800 may be made from any suitable material. Without limitation, a suitable material may be a metal, nonmetal, plastic, composite, and/or combinations thereof. In embodiments, cowl 800 may comprise a first section 805 and a second section 810. First section 805 may have a first end 815 and a second end 820. First end 815 may be in the shape of a flat, half circle. Second end 820 may be in the shape of a flat, half circle. In embodiments, second end 820 may be larger than first end 815. As the length of first section 805 increases, the cross-section may increase. First section 805 may be conical in shape. Second section 810 may be in the shape of a half cylinder. An end of second section 810 may be disposed about second end 820. Second section 810 may comprise an opening 825. Opening 825 may accommodate the shape of open section 800 of sensor package 700 (referring to FIG. 7). Second section 810 may comprise of a protective band 830. An end of protective band 830 may be disposed on one side of the central axis of opening 825. An opposing end of protective band may be disposed on the other side of the central axis of opening 825. Protective band 830 may be in the shape of an arch. In embodiments, cowl 800 may be disposed around sensor package 700 (referring to FIG. 7). There may be a suitable tolerance between protective band 830 and sensor package 700. Cowl 800 may completely cover or may partially cover sensor package 700. Cowl 800 may comprise of holes that align with holes in first section 315 (referring to FIG. 3). In embodiments, fasteners may secure cowl 800 to first section 315.

Figure 9:
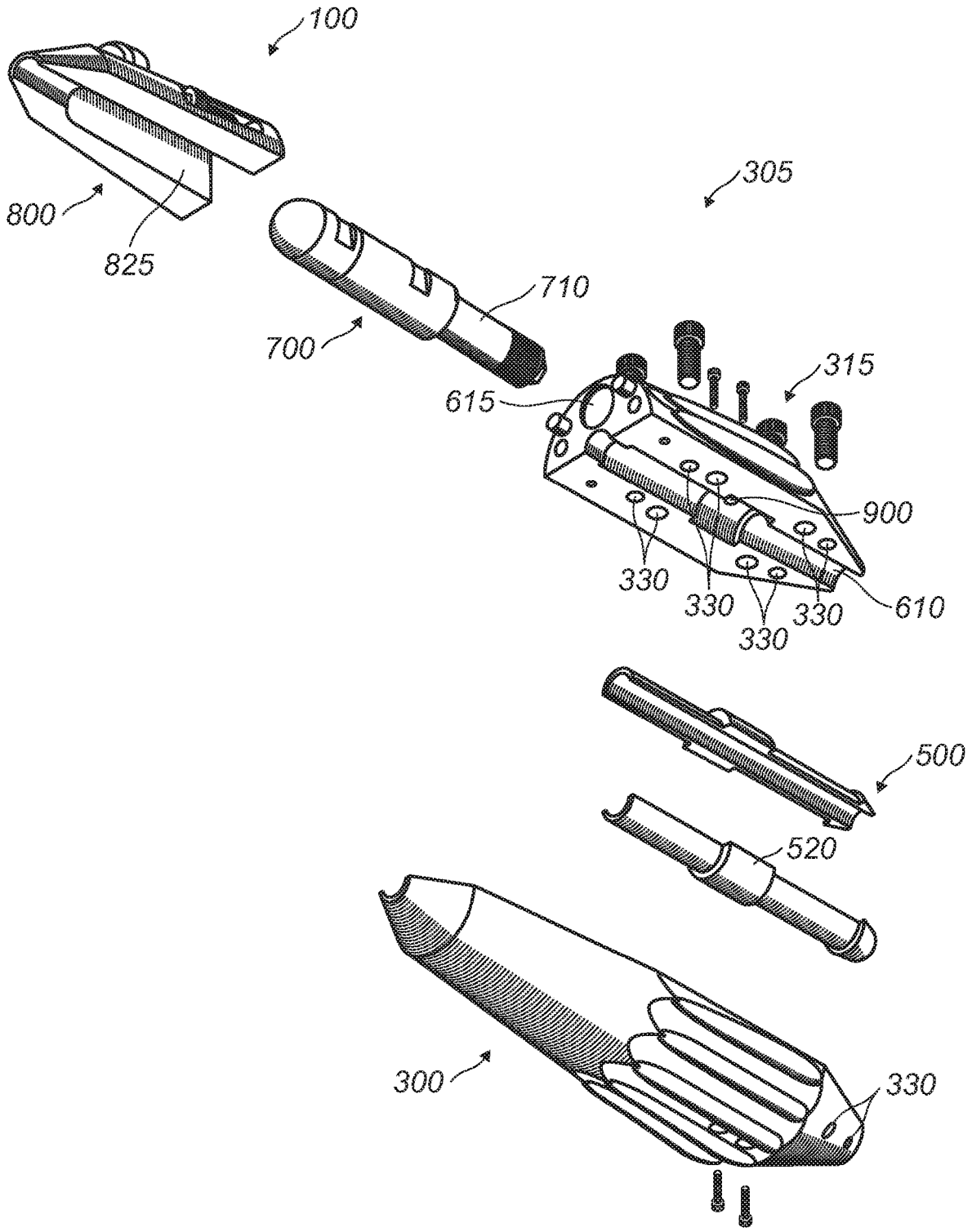
FIG. 9 illustrates an exploded, isometric view of a wireline standoff.
Figure 10:
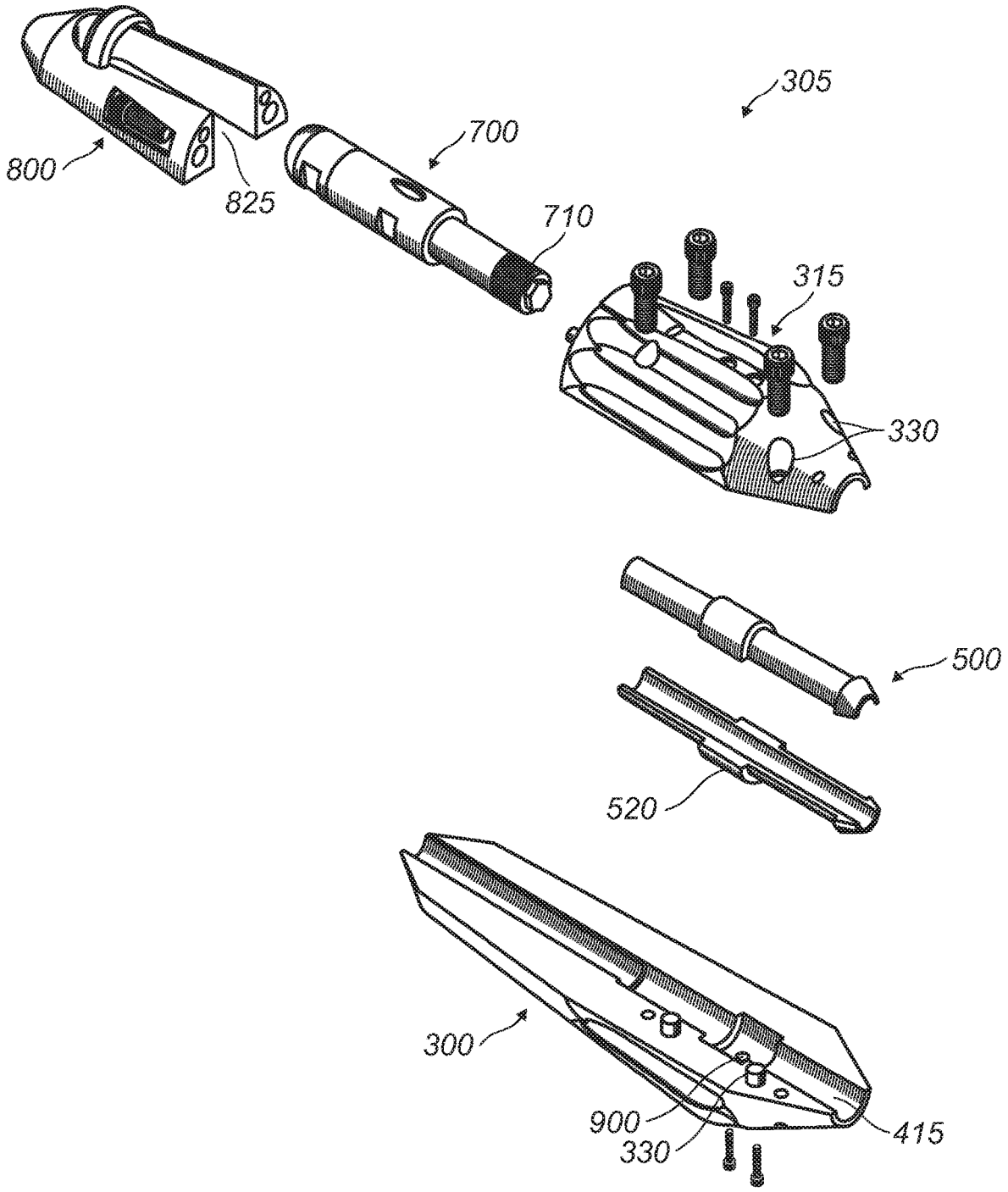
FIG. 10 illustrates another exploded, isometric view of a wireline standoff.

FIGS. 9 and 10 illustrate exploded, isometric views of environmental sensing wireline standoff 100 in accordance with embodiments of the disclosure. Both FIGS. 9 and 10 illustrate how the components of environmental sensing wireline standoff 100 align and fasten together on a wireline cable. In embodiments, an operator may assemble upper body 305 and lower body 300 separately prior to mating them together around wireline cable 105 (referring to FIG. 1). In embodiments, an operator may first secure a first segment 505 of cable insert 500 within first section 315 of upper body 305 utilizing suitable fasteners. Second segment 510 may also be secured within lower body 300 utilizing suitable fasteners. Suitable fasteners may be used to align first segment 505 and second segment 510 of cable insert 500 with both dip 610 and depression 415 of first section 315 and lower body 300 respectively, wherein dip 610 and depression 415 mirror the shape of the portion of first segment 505 and second segment 510. It should be noted that first end 515, which may be raw, may not traverse through the length of lower body 300 and upper body 305. However, in embodiments, contact with the exterior of wireline cable 105 (referring to FIG. 1) may be solely with cable insert 500 which may traverse the length of lower body 300 and upper body 305.

During installation, an anti-rotation spigot 900 may be utilized to prevent a certain motion between cable insert 500 and environmental sensing wireline standoff 100. Anti-rotation spigot 900 may prevent rotation of environmental sensing wireline standoff 100 around wireline cable 105 (referring to FIG. 1). There may be a hole disposed on central flange 520 that extends from its inner diameter to the outer diameter. A protrusion may extend from the inner wall of dip 610 and/or depression 415. The protrusion may be disposed within the hole of central flange 530 as first section 315 and lower body 300 are being assembled. In embodiments, the protrusion may act as anti-rotation spigot 900 to lock the portion of cable insert 500 in relation to dip 610 and/or depression 415.

The operator may then attach sensor package 700 to first section 315. In embodiments, a portion of stem 710 of sensor package 700 may be threaded. Internal cavity 615 of first section 315 may receive the stem 710 and may secure sensor package 700 to first section 315 through the use of threading. Cowl 800 may then be disposed around at least a portion of sensor package 700. Opening 825 of cowl 800 may accommodate the shape of sensor package 700. There may be holes in cowl 800 that align with holes in first section 315. The operator may use suitable fasteners to secure cowl 800 to first section 315.

In embodiments, the operator may then assemble lower body 300 and upper body 305 around wireline cable 105 (referring to FIG. 1) to form environmental sensing wireline standoff 100. Suitable fasteners may be used to secure lower body 300 to upper body 305 through holes 330 (i.e., M6 bolts). In embodiments, the assembly of lower body 300 to upper body 305 may create a central bore running through the length of environmental sensing wireline standoff 100 wherein wireline cable 105 (referring to FIG. 1) may be disposed. Securing the fasteners in the respective holes may prevent cable insert 500 from moving along and/or around wireline cable 105 (referring to FIG. 1), which may subsequently prevent the movement of environmental sensing wireline standoff 100. Once assembled, environmental sensing wireline standoff 100 may be disposed downhole in borehole 135 (referring to FIG. 1) to collect data as well as to reduce direct contact of wireline cable 105 to the wall of borehole 135.

Prior to disposing environmental sensing wireline standoff 100 downhole, sensor package 700 may be programmed with instructions on how to acquire data. Without limitation, the instructions may comprise of data storage, data communication, time of data acquisition, and/or combinations thereof. Sensor package 700 may be programmed at the surface with an information handling system (not illustrated) prior to disposing it downhole. Without limitation, the information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, the information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

Certain examples of the present disclosure may be implemented at least in part with non-transitory computer-readable media. For the purposes of this disclosure, non-transitory computer-readable media may include any instrumentality or aggregation of instrumentalities that may retain data and/or instructions for a period of time. Non-transitory computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such as wires, optical fibers, microwaves, radio waves, and other electromagnetic and/or optical carriers; and/or any combination of the foregoing.

Although the disclosure and its advantages have been described in detail, it may be understood that various changes, substitutions and alterations may be made herein without departing from the spirit and scope of the invention as defined by the appended claims. Although individual embodiments are discussed, the invention covers all combinations of all those embodiments.

What is claimed is:

1. An environmental sensing wireline standoff comprising:

a lower body;

an upper body having a first section and a second section, the first section including a longitudinal extending bore, a cable insert comprising:

a first segment and a second segment, wherein the cable insert is disposed between the lower body and the upper body, and wherein the cable insert is configurable to clamp directly onto a wireline cable; and a sensor package partially positioned within the longitudinal extending bore of the first section.

2. The environmental sensing wireline standoff of claim 1, wherein the second section comprises generally u-shaped body having an opening there through.

3. The environmental sensing wireline standoff of claim 2, wherein the sensor package is partially disposed within the opening of the u-shaped body.

4. The environmental sensing wireline standoff of claim 1, wherein the lower body and the upper body include an anti-rotation spigot.

5. The environmental sensing wireline standoff of claim 4, wherein a central flange is disposed on the cable insert.

6. The environmental sensing wireline standoff of claim 5, wherein a hole is disposed in the central flange.

7. The environmental sensing wireline standoff of claim 1, wherein the sensor package measures cable position, movement rotation, and acceleration, borehole temperature and pressure, borehole, fluid composition, motion and loss zones, conductivity, viscosity, gas content, road noise, borehole noise, or seismic signals.

8. The environmental sensing wireline standoff of claim 1, wherein the sensor package comprises a pressure sensor gauge, a thermocouple, a tri-axial accelerometer, or a tri-axial magnetometer.

9. The environmental sensing wireline standoffof claim 8, wherein the sensor package is programmable to collect, store, and communicate data.

10. The environmental sensing wireline standoff of claim 1, wherein the lower body and the upper body comprise a plurality of fins.

11. The environmental sensing wireline standoff of claim 10, wherein the plurality of fins are coated with a carbide coating.

12. The environmental sensing wireline standoff of claim 1, wherein the cable insert is made of aluminum.

13. The environmental sensing wireline standoff of claim 1, wherein the lower body and the upper body are made of stainless steel.

14. The environment sensing wireline standoff of claim 1 wherein the sensor passage includes threads at one end thereof adapted to mate with a threaded portion of the cavity.

15. The environment sensing wireline standoff of claim 1 wherein the first and second sections are secured to each other by fasteners.

16. A method of assembling an environmental sensing wireline standoff, comprising:

securing a first segment of a cable insert into a lower body;

securing a second segment of the cable insert into an upper body wherein the upper body includes a first section and a second section, the first section including a longitudinally extending bore;

placing attaching the a sensor package in the bore of the first section of to the upper body; and securing the lower body to the upper body.

17. The method of claim 16, further comprising disposing an anti-rotation spigot into a central flange disposed on the first segment or the second segment of the cable insert.

18. The method of claim 16, further comprising deforming the cable insert around a wireline.

19. The method of claim 16, wherein the cable insert comprises a first end that is raw and a second flanged end.

* * * * *